US006981431B2

(12) United States Patent
Krämer

(10) Patent No.: US 6,981,431 B2
(45) Date of Patent: Jan. 3, 2006

(54) CORK EXTRACTOR FOR CORKS OF BOTTLES OF CHAMPAGNE, SPARKLING WINE, PROSECCO, CIDER OR THE LIKE

(75) Inventor: Ralph Krämer, Saarbrucken (DE)

(73) Assignee: Fackelmann GmbH + Co., Hersbruck (DE)

( * ) Notice: Subject to any disclaimer, the term of this patent is extended or adjusted under 35 U.S.C. 154(b) by 97 days.

(21) Appl. No.: 10/679,435

(22) Filed: Oct. 7, 2003

(65) Prior Publication Data

US 2004/0168552 A1 Sep. 2, 2004

(30) Foreign Application Priority Data

Oct. 7, 2002 (DE) ..... 102 46 716

(51) Int. Cl.
*B67B 7/16* (2006.01)

(52) U.S. Cl. ..... 81/3.56; 81/3.37

(58) Field of Classification Search ..... 81/3.29, 81/3.36, 3.37, 3.55, 3.56
See application file for complete search history.

(56) References Cited

U.S. PATENT DOCUMENTS

| | | | | |
|---|---|---|---|---|
| 2,761,338 A | | 9/1956 | Hardy | |
| 4,442,735 A | * | 4/1984 | Chance et al. | 81/3.36 |
| 4,598,613 A | | 7/1986 | Baum | |
| 4,680,993 A | * | 7/1987 | Feliz | 81/3.37 |
| 4,708,033 A | * | 11/1987 | Eash | 81/3.37 |
| 4,750,391 A | * | 6/1988 | Sweatt | 81/3.37 |
| 4,756,214 A | * | 7/1988 | Valtri et al. | 81/3.36 |
| 4,798,106 A | * | 1/1989 | Foster | 81/3.29 |
| 4,875,394 A | * | 10/1989 | Crudgington, Jr. | 81/3.36 |
| 4,887,497 A | * | 12/1989 | Daviddi | 81/3.37 |
| 4,947,711 A | * | 8/1990 | Giebeler | 81/3.37 |
| 5,000,063 A | * | 3/1991 | Federighi, Sr. | 81/3.37 |
| 5,275,070 A | * | 1/1994 | St. Denis | 81/3.29 |
| 5,868,044 A | * | 2/1999 | Sonderman | 81/3.29 |
| 5,934,160 A | * | 8/1999 | Gibson | 81/3.37 |
| 6,386,069 B1 | * | 5/2002 | Olivera et al. | 81/3.29 |

FOREIGN PATENT DOCUMENTS

| | | |
|---|---|---|
| EP | 0 229 560 | 7/1987 |
| EP | 0 291 546 | 3/1991 |

* cited by examiner

*Primary Examiner*—David B. Thomas
(74) *Attorney, Agent, or Firm*—Browdy and Neimark, PL

(57) ABSTRACT

In a cork extractor for corks of bottles of champagne, sparkling wine, prosecco, cider or the like, wherein a build-up portion of said cork surrounds the front side of the bottleneck while a driving collar of the corkscrew engages the build-up portion of said cork from beneath for pulling out said cork, wherein the driving collar is liftable by means of an actuating means shaped as a lever or spindle drive in the direction of the longitudinal axis of the bottle relative to an abutment collar supported by the bottle, it is envisaged for accomplishing a simple and reliable handling that said driving collar is arranged on a first half-cylinder shell, that said abutment collar is formed on a second, complementary half-cylinder shell, and that each of said half-cylinder shells comprises a recess for the build-up portion of said cork, wherein said driving collar is liftable by means of said actuating means for pulling out said cork while said cork is guided along said second half-cylinder shell during its being lifted.

8 Claims, 2 Drawing Sheets

CORK EXTRACTOR FOR CORKS OF BOTTLES OF CHAMPAGNE, SPARKLING WINE, PROSECCO, CIDER OR THE LIKE

BACKGROUND OF THE INVENTION

1. Field of the Invention

The present invention relates to a cork extractor for corks of bottles of champagne, sparkling wine, prosecco, cider or the like, wherein a build-up portion of the cork surrounds the front side of the bottleneck while a driving collar of the cork extractor engages the build-up portion of the cork from beneath for pulling out the cork, wherein the driving collar is liftable by means of an actuating means shaped as a lever or spindle drive in the direction of the longitudinal axis of the bottle relative to an abutment collar supported by the bottle.

2. Background Art

Cork extractors of this type having a swivel lever are known from U.S. Pat. No. 4,598,613 and EP 0 291 546. EP 0 229 560 A1 and U.S. Pat. No. 2,761,338 describe cork extractors of this type, wherein the actuating means is designed as a thread arrangement.

All known solutions share the disadvantage of either not allowing an attractive design or being difficult to handle.

SUMMARY OF THE INVENTION

Therefore, it is an object of the present invention to provide a cork extractor of the type described above which is inexpensive to manufacture, has an attractive design and at the same time is easy to handle so that users having relatively small hands and little force can effortlessly and safely use the corkscrew.

According to the present invention, this object is achieved by arranging the driving collar on a first half-cylinder shell, forming the abutment collar on a second complementary half-cylinder shell, and providing each of the two half-cylinder shells with a recess, respectively, for the build-up portion of the cork, wherein the driving collar is liftable by means of the actuating means to pull out the cork, wherein during the lifting action the cork is guided along the second half-cylinder shell.

The design according to the present invention provides a symmetrical force distribution so that tilting moments are avoided during handling. The cork is always safely guided and fixed after being pulled out of the bottleneck so as to be easily removable.

In another embodiment of the invention, the actuating means is shaped as a swivel lever, wherein a swivel bearing for the swivel lever is provided at the upper end of each half-cylinder shell so that an inner lever portion of the swivel lever bridges the two swivel bearings.

Preferably, the corkscrew is made of metal, wherein it is possible to provide the inner side of the swivel lever and/or the outer side of the second half-cylinder shell with a plastic coating or plastic lining.

For securely guiding and gripping the cork head, an engaging collar roughly corresponding to the height of the cork build-up may be formed above the driving collar in such a manner that the cork build-up is arranged between the driving collar and the engaging collar when the cork extractor is applied.

In order to accomplish a defined guidance during the pulling-out action, a guiding collar may be arranged on the second half-cylinder shell below the abutment collar.

According to a preferred embodiment, it is envisaged that each swivel bearing comprises a swivel bearing bolt arranged between two fork-like swivel bearing flanges, wherein the swivel bearing flanges are arranged with recesses in the surface of the inner portion of the swivel lever so that the borders of the recesses act as stops for the swivelling motion.

Now, the invention will be described in greater detail with respect to a preferred example embodiment with reference to the drawing.

DESCRIPTION OF THE PREFERRED EMBODIMENT

Figures 1, 2, 3, 4:
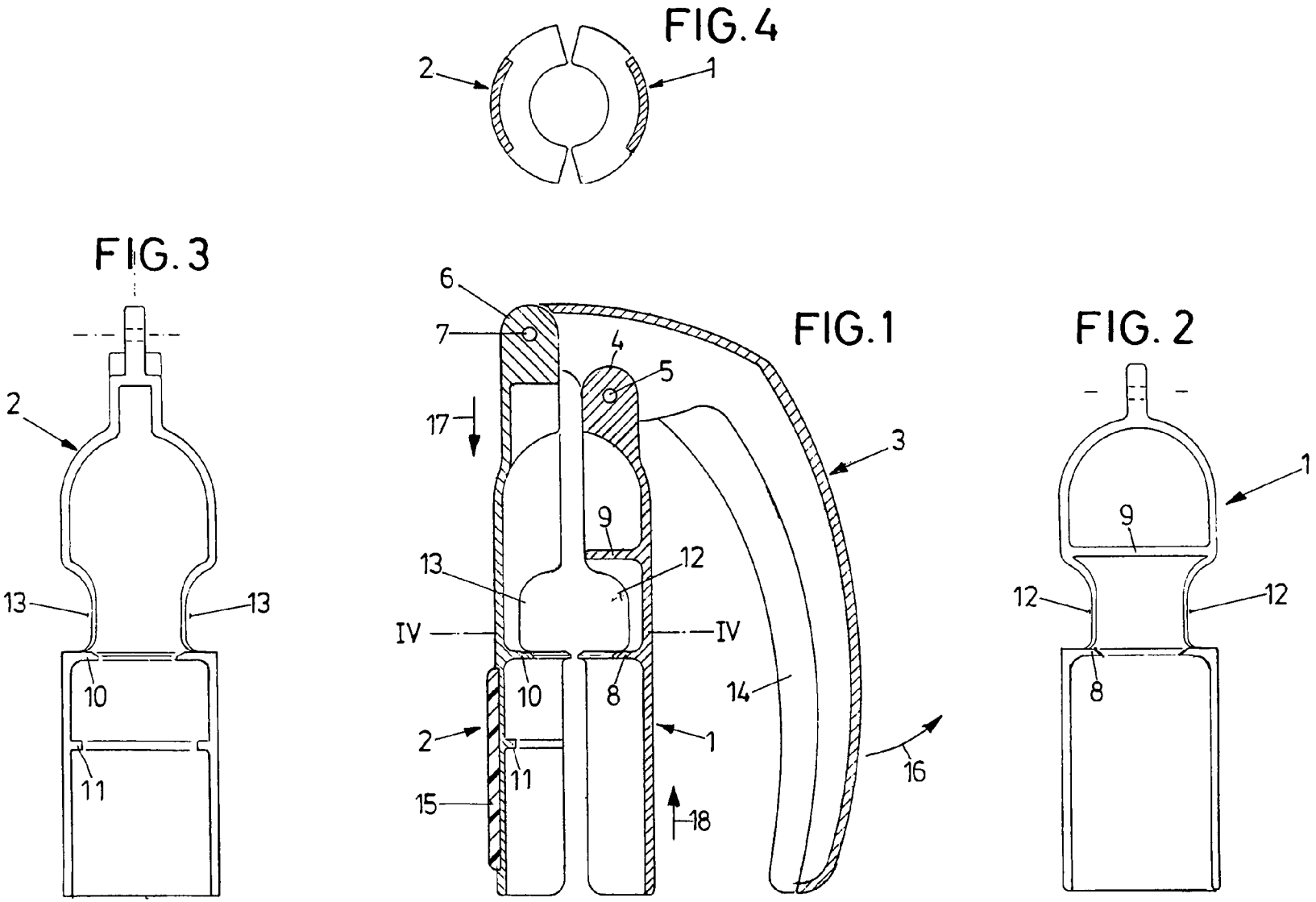
FIG. 1 shows a longitudinal section through a complete cork extractor according to the present invention.
FIG. 2 shows an inside view of a first half-cylinder shell.
FIG. 3 shows an inside view of a second half-cylinder shell.
FIG. 4 shows a section along the line IV—IV in FIG. 1.

A cork extractor as shown in the drawing comprises a first half-cylinder shell 1, a second half-cylinder shell 2 and a swivel lever 3 as actuating means.

A swivel bearing flange 4 having a swivel bearing bore 5 is arranged on the upper side of the first half-cylinder shell 1 while a swivel bearing flange 6 having a swivel bearing bore 7 is arranged on the upper side of the second half-cylinder shell 2, which bores each receive swivel bearing bolts (not shown) arranged on the swivel lever.

A driving collar 8 projecting towards the inside and an engaging collar 9 being arranged above the former at a distance roughly corresponding to the height of the build-up of a champagne cork are formed on the first half-cylinder shell 1.

In the initial position shown in FIG. 1, in which the champagne cork is gripped, an abutment collar 10 is formed on the second halt-cylinder shell 2 at the height of the driving collar 8 with a guiding collar 11 being formed below the former to engage the bottleneck of the bottle from which a cork is to be extracted.

Each of he first half-cylinder shell 1 and the second half-cylinder shell 2 comprises a recess 12, 13, respectively, roughly corresponding to the size and shape of the build-up portion of the champagne cork to be pulled out.

A plastic lining 14 is provided on the inner side of the swivel lever 3 while a plastic lining 15 is provided on the outer side of the second half-cylinder shell 2.

The corkscrew is used as described below.

As the swivel lever 3 is gripped by the user's first hand , the outer side of both half-cylinder shells 1, 2 is gripped by the user's second hand. Thereafter, the driving collar 8 and the abutment collar 10 are pressed into the gap between the bottom end of the build-up of the cork and the top end of the bottleneck so that the abutment collar 10 is supported on this top end while the driving collar 8 engages the bottom end of the cork build-up.

Thereafter, when the swivel lever 3 is swivelled upwards in the direction of the arrow 16, a downward force is exerted on the second half-cylinder shell 2 via the swivel bearing 7 in the direction of the arrow 17 so that the abutment collar

10 is supported on the top end of the mouth of the bottle and an upward force exerted on the first half-cylinder shell 1 in the direction of the arrow 18 are applied so that the build-up portion of the cork and with it the cork itself is driven upwards in the direction of the longitudinal axis of the bottle and pulled out of the mouth of the bottle, wherein the portion of the second half-cylinder shell 2 above abutment collar 10 serves as a guide for the cork and at the same time fixes it in a defined manner after having been removed from the mouth of the bottle so that the cork cannot fly off.

Figure 6:
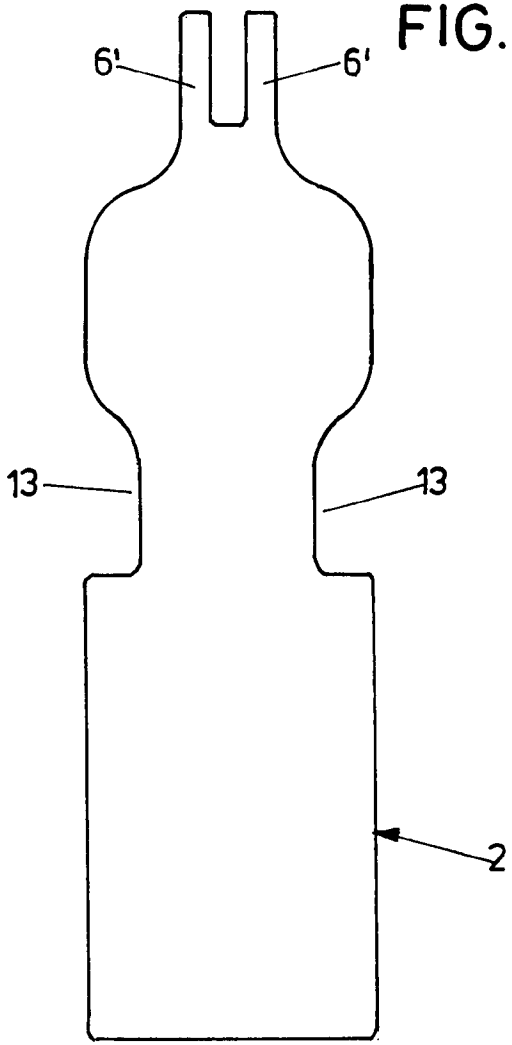
FIG. 6 shows a view of the second half-cylinder shell in the direction of the arrow VI in FIG. 5.
Figure 5:
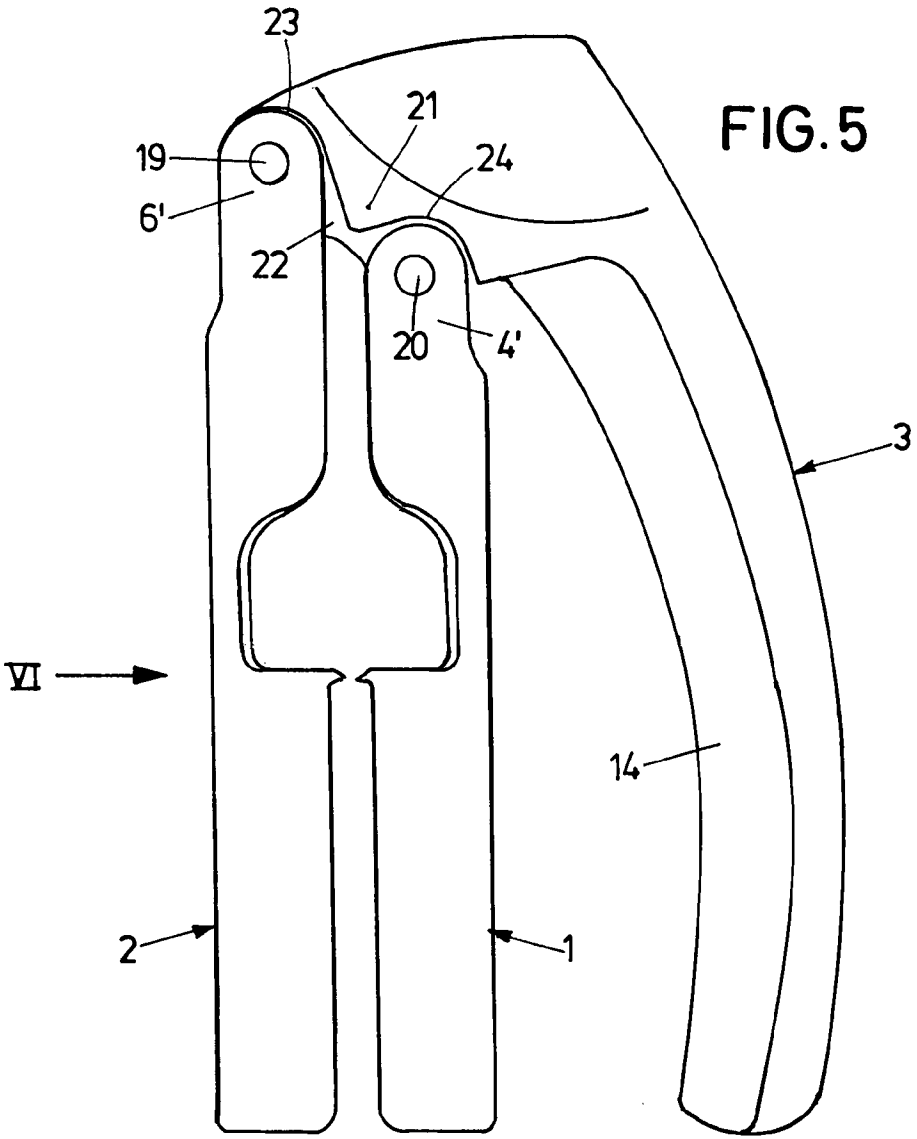
FIG. 5 shows a lateral view of a second embodiment of a cork extractor according to the present invention.

In the second embodiment shown in FIGS. 5 and 6, it is envisaged that swivel bearing bolts 19, 20 for bearing the swivel lever 3 are arranged in fork-shaped swivel bearing flanges 4', 6'. The end portion 21 of the swivel lever 3 comprises a recess 22 for the swivel bearing flanges 4', 6', wherein the borders 23, 24 of the recess 22 act as stops for the swivelling motion of the swivel lever 3.

What is claimed is:

1. A cork extractor for corks of bottles, wherein a build-up portion of said cork surrounds a top end of a bottleneck of a bottle while a driving collar of the cork extractor engages a build-up portion of said cork from beneath for pulling out said cork, wherein the driving collar is liftable by means of an actuating lever in the direction of a longitudinal axis of the bottle relative to an abutment collar supported on the bottle, wherein said driving collar (8) is arranged on a first half-cylinder shell (1) and said abutment collar (10) is formed on a second, complementary half-cylinder shell (2), wherein each of said half-cylinder shells (1, 2) comprises a recess (12, 13) for enclosure of the build-up portion of said cork, wherein said driving collar (8) is liftable by means of said actuating lever for pulling out said cork while said cork is guided along said second half-cylinder shell (2) during lifting of the cork.

2. The cork extractor according to claim 1, wherein said actuating lever is formed as a swivel lever (3), wherein a swivel bearing for said swivel lever (3) is provided on an upper end of each half-cylinder shell (1, 2), respectively, in such a manner that an inner lever portion (21) of said swivel lever (3) bridges the two swivel bearings.

3. The cork extractor according to claim 2, wherein an inner side of said swivel lever (3) and/or an outer side of said second half-cylinder shell (2) is provided with a plastic coating or plastic lining (14, 15).

4. The cork extractor according to claim 1, wherein an engaging collar (9) is formed above said driving collar (8) at a height roughly corresponding to said build-up portion of said cork so that said build-up of the cork is arranged between said driving collar (8) and said engaging collar (9).

5. The cork extractor according to claim 1, wherein a guiding collar (11) is arranged on said second half-cylinder shell (2) below said abutment collar (10).

6. The cork extractor according to claim 2, wherein each swivel bearing comprises a swivel bearing bolt (19, 20) arranged between two fork-like swivel bearing flanges (4', 6'), wherein said swivel bearing flanges (4', 6') are respectively arranged in recesses (22) on a surface of the inner lever portion (21) of said swivel lever (3) so that borders (23, 24) of said recesses (22) act as stops for a swivelling motion.

7. The cork extractor according to claim 1, wherein the bottle contains champagne, sparkling wine, presecco, cider or other consumable drink.

8. The cork extractor according to claim 1, wherein said cork is guided along a portion of said second complementary half-cylinder shell (2) above said abutment collar (10) during lifting of the cork.

* * * * *